US007661149B2

(12) United States Patent
Ottah et al.

(10) Patent No.: US 7,661,149 B2
(45) Date of Patent: Feb. 16, 2010

(54) PERSONAL CARE CAPE

(76) Inventors: Chikezie Ottah, 1035 Clarkson Ave., Suite 5A, Brooklyn, NY (US) 11212; Kenneth Ottah, No. 4, 6th Avenue, Trans - Ekulu GRA, Enugu, Enugu State (NG); Chika Ottah, No. 4, 6th Avenue, Trans - Ekulu GRA, Enugu, Enugu State (NG)

( * ) Notice: Subject to any disclaimer, the term of this patent is extended or adjusted under 35 U.S.C. 154(b) by 275 days.

(21) Appl. No.: 11/796,696

(22) Filed: Apr. 30, 2007

(65) Prior Publication Data

US 2008/0060109 A1 Mar. 13, 2008

Related U.S. Application Data

(60) Provisional application No. 60/825,294, filed on Sep. 12, 2006.

(51) Int. Cl.
*A41D 13/04* (2006.01)
*A45D 44/08* (2006.01)

(52) U.S. Cl. ..... 2/50; 4/521; 4/655

(58) Field of Classification Search ..... 2/48, 2/50, 51, 52, 49.1–49.5, 88, 46, 456, 69, 2/69.5, 174; 297/182; 4/519, 520, 521, 655, 4/654, 658, 515–518, 523, 580, 581, 583, 4/245.1, 245.3–245.5, 245.7–245.9, 287, 4/295

See application file for complete search history.

(56) References Cited

U.S. PATENT DOCUMENTS 1,270,704 A * 6/1918 Creery ..... 2/88
1,377,541 A * 5/1921 Young ..... 4/245.9
1,497,685 A * 6/1924 Hoyme ..... 2/67
1,660,124 A 2/1928 Grom
2,170,703 A * 8/1939 Waxman et al. ..... 2/49.4
2,357,461 A * 9/1944 Ellinger ..... 4/521
2,817,851 A * 12/1957 Barnwell ..... 4/655
3,639,915 A 2/1972 Hrubecky
3,654,629 A 4/1972 Crisman et al.
3,996,946 A * 12/1976 Craig ..... 132/212
4,014,054 A * 3/1977 Pasquarello ..... 4/521
4,458,364 A 7/1984 Andrew et al.
4,611,354 A * 9/1986 Jones ..... 2/174
4,689,830 A 9/1987 Williams
4,980,927 A 1/1991 Wawiluk et al.
5,023,963 A * 6/1991 Vogel ..... 4/521
5,079,777 A 1/1992 Fowler et al.
5,146,629 A * 9/1992 Barnes ..... 2/174

(Continued)

*Primary Examiner*—Amy B Vanatta
(74) *Attorney, Agent, or Firm*—Porter, Wright, Morris & Arthur, LLP

(57) ABSTRACT

A cape for protecting a user and a utility such as a sink or a tub from damage by chemical or biological waste generated during personal care procedures by seamlessly covering both while being attached to both the user and the utility. The cape including a neck portion adapted to be secured to the user at a neck. The cape further including an outer edge spaced from the neck portion to cover the user and extend over the sink, a plurality of holes formed in the cape to adapt to the sink and a connector to hold the cape on the sink. The connector may be a magnet fastener, a drain ring to secure the cape to the drain hole, adhesive backed tape or hook and loop material.

19 Claims, 3 Drawing Sheets

U.S. PATENT DOCUMENTS 5,153,950 A * 10/1992 Sowers ..... 4/580
5,168,579 A * 12/1992 Marshall ..... 2/88
5,216,760 A * 6/1993 Brown et al. ..... 4/300.3
5,657,489 A * 8/1997 Ponstein ..... 2/69
5,946,745 A * 9/1999 Magee ..... 4/522
5,950,236 A 9/1999 Andrew et al.
D415,603 S * 10/1999 Wampler ..... D2/823
5,991,942 A * 11/1999 Neal ..... 4/655
6,415,458 B1 * 7/2002 McFadden ..... 4/521
6,519,777 B1 * 2/2003 Speelman ..... 2/174
6,663,176 B1 * 12/2003 Tull ..... 297/182
7,458,104 B1 * 12/2008 Garcia ..... 2/69.5
2007/0180610 A1 * 8/2007 Mohr et al. ..... 4/655

* cited by examiner

PERSONAL CARE CAPE

CROSS-REFERENCE TO RELATED APPLICATIONS

The present application claims the priority benefit of U.S. Provisional Application No. 60/825,294 filed on Sep. 12, 2006.

STATEMENT REGARDING FEDERALLY SPONSORED RESEARCH

Not Applicable

FIELD OF THE INVENTION

The present invention relates to a disposable cover and cape combination for use in a personal care salon. The present invention is designed to protect the wearer's clothes and the adjacent utilities during shaving, hair dressing, exfoliating or performing other personal grooming activities.

BACKGROUND OF THE INVENTION

Capes are well known in the art for protecting a wearer from soiling or staining clothes during hair dressing. Chemicals from styling, bleaching, coloring, shampooing and waxing hair may splash or drip and stain clothes. Such prior art capes also prevent soiling from hair dropping during hair cutting and styling.

Prior art disclosures include U.S. Pat. No. 3,639,915 to Hrubecky disclosing and claiming a disposable garment and method of making same. Customers wear the garment in a personal care salon or barbershop. The '915 patent discloses treating the garment with chemicals to resist bacterial and fungus growth.

Furthermore, U.S. Pat. No. 3,654,629 to Chrisman et al. discloses a disposable bib for protecting the wearer. The bib is folded in the '629 patent to fit snugly around the wearer's neck.

U.S. Pat. No. 5,079,777 to Fowler discloses and claims an article of clothing worn by the user while receiving treatment for protecting the wearer. The '777 patent discloses a two piece cover wherein a towel is removably attached to the wearer and a cover piece similarly removably attached is released to remain in the sink or basin after shampooing or the like.

The prior art does not protect both the wearer and the surrounding facilities from waste water and chemicals used during the personal grooming procedures. The chemical waste is rinsed into an adjacent sink, tub or other drain to be flushed into the waste water system. Biological waste such as hair clippings are flushed or fall to the floor for later cleanup. The prior art does not incorporate an integral utility cover to protect the porcelain, metal or painted finish of the drainage device. The chemicals may cause staining, corrosion or other surface damaging reactions with the sink or tub.

In addition, the particulate waist from the personal care procedure is allowed to drop to the floor or onto the adjacent utilities. This necessitates a clean up operation after each customer is finished. The clean up includes sweeping, vacuuming or mopping the floor and wiping down the surfaces of adjacent utilities and equipment to remove hair pieces and other particulate waste.

SUMMARY OF THE INVENTION

The present invention solves this problem by integrating a cover with the cape to protect the user and her clothes, the surfaces of the sink or drain and the surrounding floor. The present invention is adapted to allow access to water controls, supply and drain, while protecting the fixture from damage or soiling.

The present invention is designed to remedy this by providing a cape to protect both the user and the adjacent sink or utility during personal care treatments. The cape is sized, shaped and adapted to cover the adjacent sink, tub or other drain utility used during the procedure.

An object of the present invention is to provide a cape that is adapted to cover the wearer and the adjacent sink during personal care procedures using chemicals that may harm the wearer's cloths or the finish on the sink.

Another object of the present invention is to provide a cape that is attached to the user and the adjacent bath tub to seamlessly cover and protect both during personal care procedures.

Another object of the present invention is to provide a device that can be cut from sheet stock by the user.

Another object of the present invention is to provide a disposable cape for covering the wearer and the utilities to prevent the spread of disease or parasites.

Another object of the present invention is to provide a fixture to align cuttings on the cape material to adapt the cape to cover the adjacent utilities.

DETAILED DESCRIPTION OF THE INVENTION

Figure 1:
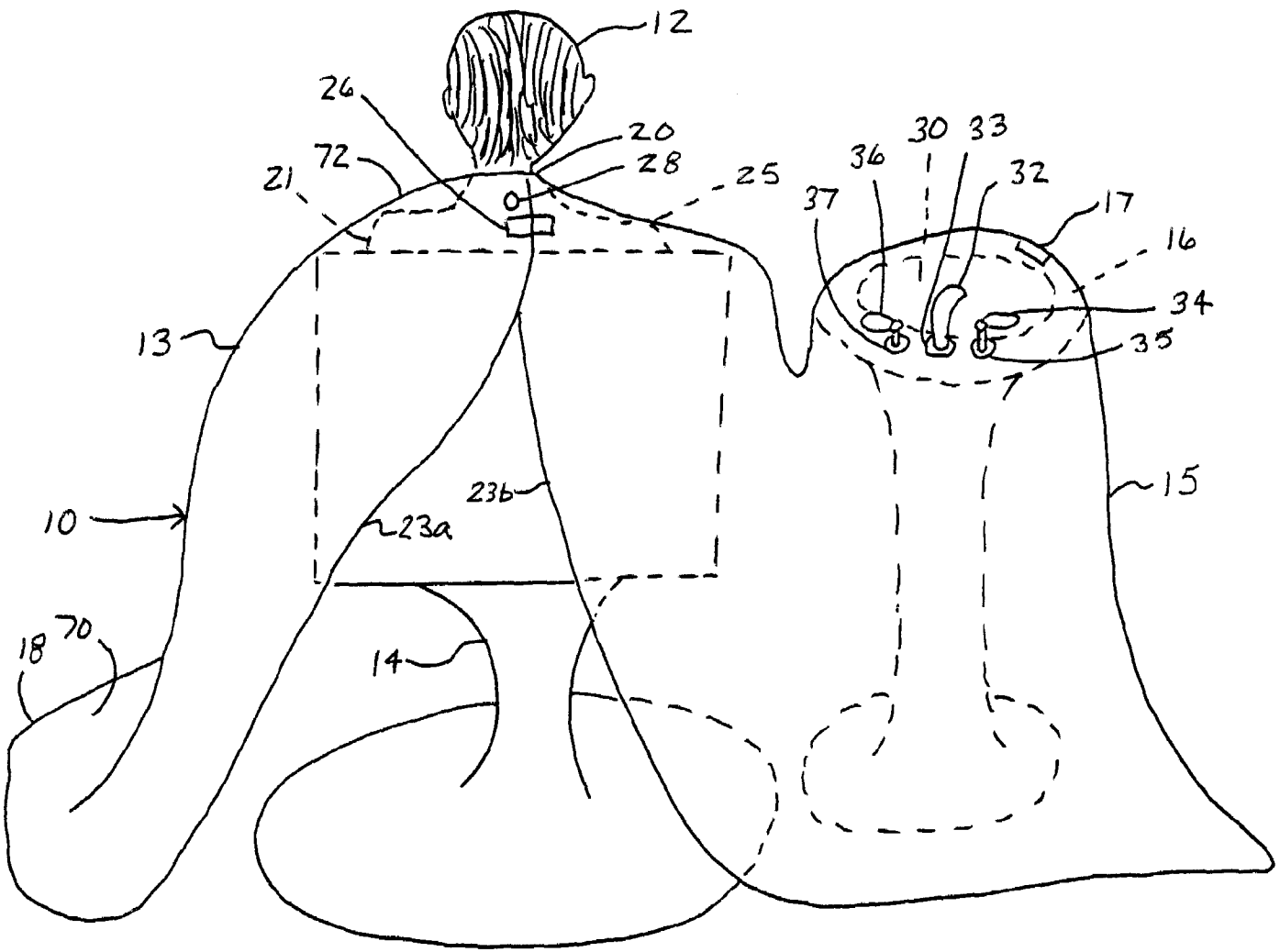
FIG. 1 is a side elevation of the present invention covering a wearer and a sink next to the wearer.

The present invention is illustrated in FIG. 1 showing the cape 10 on the user 12 sitting in a chair 14. The user 12 is sitting next to a sink 16 having the cape 10 covering both the user 12 and the sink 16. The cape 10 comprises a user portion 13, a sink portion 15 and an outside edge 18. The outside edge 18 defines the size and shape to protect the covered area around the user 12 including the sink 16 from damage due to waste from the personal care treatment. The cape 10 may be made from a water or chemical resistant material, a surplus material having one or more plies and being flexible to drape over the user 12 and utilities 16.

The cape 10 is held to the sink 16 by a fastener 17 such as a magnet. The access slit 19 extends from the outside edge 18 to the neck opening 20. The neck opening 20 is adjustably fitted to the user 12 by a fastener 26 on the access slit 19 such as adhesive tape, hook and loop fasteners, a button 28 or other fastener as is known in the art. The cape 10 rests on the user's shoulders 25 and covers the arms 21 and the legs 23 (FIG. 2).

The sink 16 comprises a bowl 30, a faucet 32, a first water handle 34 and a second water handle 36. The cape 10 is adapted to cover the sink 16 while leaving the water faucet 32 and a drain 38 functional by extending the faucet 32 through a faucet hole 33 and the drain 38 concentrically aligned with a drain hole 39. Likewise, the first water handle 34 is extended through the cape at the first handle hole 35 and the second water handle 36 is extended through the cape 10 at the second handle hole 37.

Figure 2:
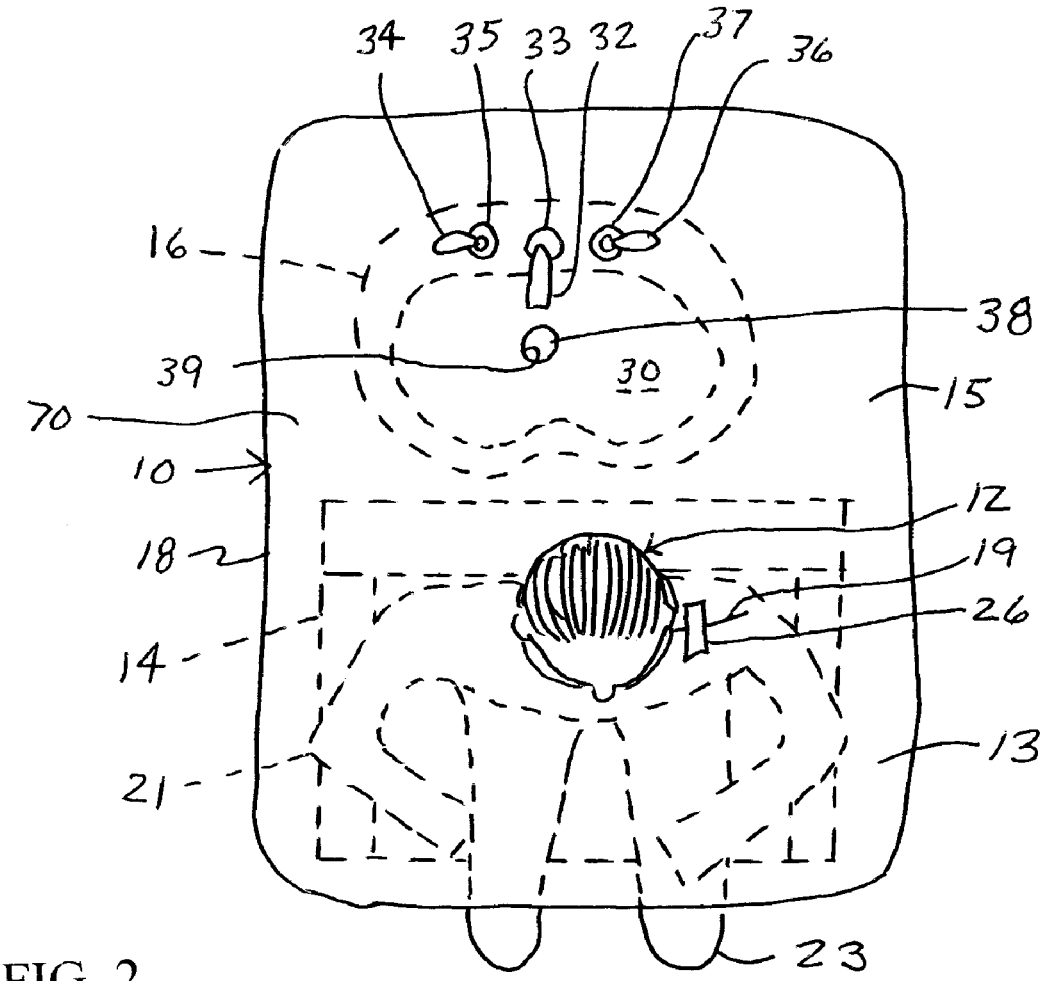
FIG. 2 is a top view of the present invention covering a wearer and a sink behind the wearer.

Referring to FIG. 2, the sink 16 is shown behind and adjacent to the user 12. The sink 16 is covered by the cape 10 extending seamlessly over the user 12 and the sink 16. The outside edge 18 surrounds and covers a portion of the user 12 and extends over the sink 16 to seamlessly protect the user 12 and the sink 16. The sink 16 as shown in FIG. 2 further comprises a drain 38 concentrically aligned with a drain hole 39 in the cape 10 to allow liquids to drain from the sink 16. The utility distance 73 is measured from the user 12 to the drain 38 to configure the cape 10 to a particular user/sink configuration.

Figure 3:
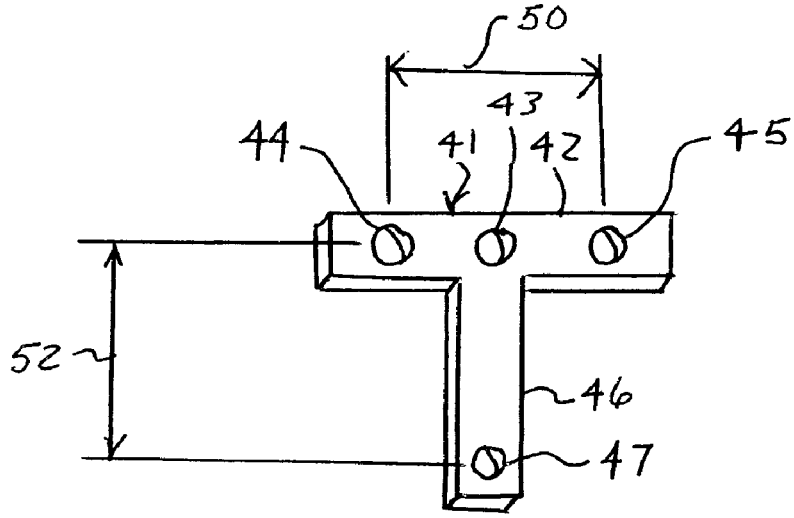
FIG. 3 is a perspective view of a fixture used to adapt the present invention to fit over a sink or tub.

Referring to FIG. 3, a fixture 41 is provided to cut sheet material to provide a pattern to cut the plurality of holes in the sheet 70 to form the cape 10. The fixture 41 has a control bar 42 having a faucet hole locator 43, first handle hole locator 44 and second handle hole locator 45. A drain bar 46 is connected to the control bar 42 at a right angle adjacent to the faucet hole locator 43. A drain hole locator 47 is formed in the fixture 41 on the drain bar 46.

The handle spacing 50 between the first handle hole locator 44 and the second hole locator 45 is a first standard dimension for most sink 16 and faucet fixtures. Likewise, the drain spacing 52 is a second standard dimension between the faucet 32 and the drain 38. Typically, the faucet hole 33 is midway between the first and second handles 34, 36. The fixture 41 is used with a marker to trace the hole locations on the sheet 70 and a knife or scissors (not shown) to cut holes at the traced locations to adapt the cape 10 to the faucet, handles and drain of a sink 16 (FIG. 2) or tub 54 (FIG. 4).

Figure 4:
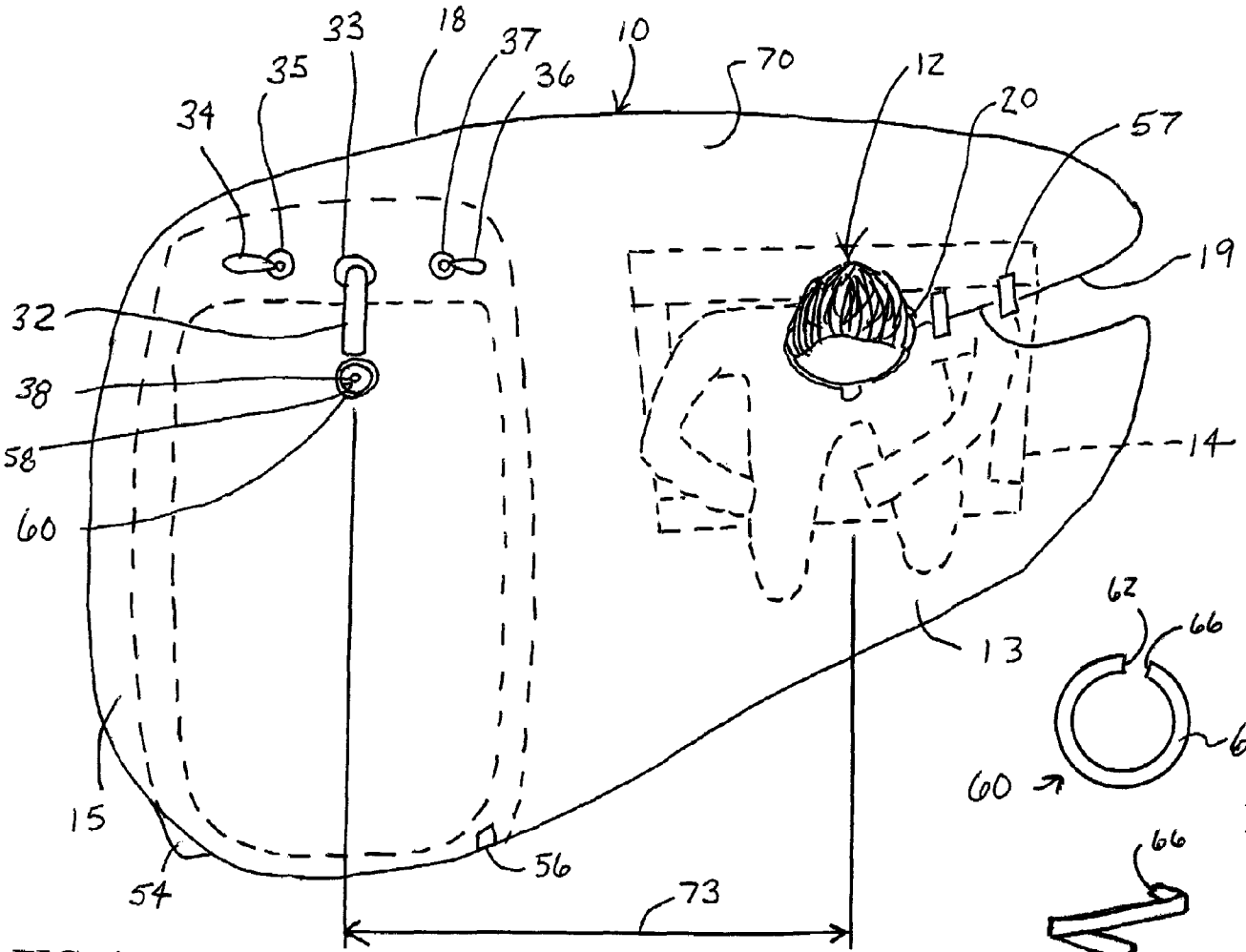
FIG. 4 is a top view of the present invention covering a wearer and a bath tub beside the wearer.

Referring to FIG. 4, the cape 10 is shown protecting a user 12 and extending over and adapted to fit on a bath tub 54. The cape 10 is adapted to the tub 54 by a faucet hole 33, the first handle hole 35 and the second handle hole 37 to fit over the water controls of the bath tub 54.

The cape is adapted to the drain 38 having the drain hole 39 in the cape 10 concentrically aligned with the inner surface 58 of the drain 38. A drain ring 60 is inserted in the drain hole 38 to bear against the cape 10 at the drain hole 39 to hold the cape 10 between the drain ring 60 and the inner surface 58 of the drain 38. The cape 10 is further held in place by a fastener shown as tape 56. Magnetic tape 56 may be used on some porcelain tubs 54. Adhesive tape 56 may be alternatively used on most tubs 54.

Figure 5:
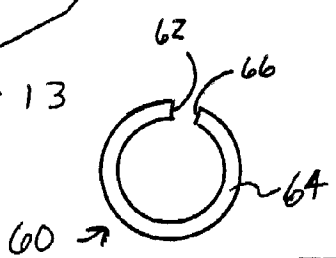
FIG. 5 is a perspective view of a drain ring.
Figure 6:
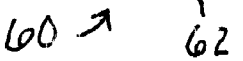
FIG. 6 is a side view of the drain ring of FIG. 5.

Referring to FIGS. 5 and 6, the drain ring 60 is formed of a spiral shaped non-continuous resilient material in a helix shape. The drain ring 60 is placed in the drain by compressing the helix shape by flexing the first end 62 toward the second end 66 thus reducing the diameter of the ring 60 and allowing the user 12 to insert the drain ring 60 in the drain 38. The flex portion 64 flexes to allow the ring 60 to compress to a shape and size having a smaller diameter by compressing the first end 62 closer to the second end 66. When released, the resilient material in the flex portion 64 will bear against the ends 62, 66 to return the ring 60 to its at rest shape shown in FIG. 5 when placed in the drain 38. The portion of the cape 10 adjacent the drain hole 39 is positioned between the ring 60 and the inner surface of the drain 38. The drain ring 60 will hold the cape 10 in place, anchored at the drain 38, to allow waste products on the cape 10 to flow by gravity to the drain 38 and thus the cape 10 protects the sink 12 (FIG. 1) or tub 54.

A sheet 70 of cape material is formed into a cape 10 by use of the fixture 41. The sheet 70 may be a single layer of fabric or paper material or a laminated multi layer assembly. Preferably, the sheet 70 is water resistant to prevent water and chemical runoff from the personal care treatment from seeping through the cape 10 to the user 12 or the sink 16. The neck end 72 is cut to form a neck opening 20. Depending on the physical layout of the chair 14 and sink 16, the fixture 41 is placed on the material 70 and holes formed in the material 70 to adapt the cape 10 to the layout.

The method of making a personal care cape for covering a user having a neck, the personal care cape comprises the steps of:

1. Cutting a sheet 70 from a material in a shape and having a size large enough to cover a user 12 and a utility 16 having a drain 38, a faucet 32, a first handle 34 and a second handle 36, the sheet having an outer edge 18;

2. Measuring a utility distance 73 between the user 12 and the drain 16;

3. Marking a neck hole position on the sheet for a neck hole 20;

4. Marking a drain hole position on the sheet at a distance equal to or greater than the utility distance 73 from the neck hole 20;

5. Placing a fixture 41 on the sheet where the fixture 41 has a control bar 42 and a drain bar 46 with the control bar 41 comprising a plurality of hole locators 43, 44, 45 formed as holes in the fixture 41 and a drain hole locator 47 formed in the drain bar 46;

6. Positioning the fixture 41 on the sheet 70 to align the drain hole locator 47 on the fixture 41 with the mark indicating the drain hole position for the drain hole 39 on the sheet.

7. Tracing onto the sheet 70 though the hole locators 43, 44, 45 and 47 with a pen marker or the like to mark locations on the sheet 70;

8. Marking the sheet 70 to locate a neck hole 19 on the sheet 70;

9. Marking the sheet 70 to locate a drain hole 39 on the sheet 70;

10. Holding the fixture 41 in a fixed position with respect to the sheet 70 while tracing a mark in each hole locator 43, 44, 45 and 46 to mark the sheet;

11. Cutting a plurality of holes 33, 35, 37, 39 in the sheet 70 at the traced marks to form an opening in the sheet at each respective location for each of the drain hole 39, the faucet hole 43, the first handle hole 44 and the second handle hole 45, to adapt the sheet 70 to fit over the sink 16;

12. Cutting the sheet 70 to form the neck hole 20 adapted and sized to fit the user 12;

13. Cutting an access opening 19 in the sheet 70 by forming a slit 19 cut in the sheet 70 from the neck hole 20 to the outer edge 18 to allow the cape 10 to be fitted to the user 12, where the slit 19 has a first edge 23*a* and a second edge 23*b;*

14. Attaching a connector 57 to the first edge 23*a* of the slit 19 to removably hold the access opening in a closed position (FIG. 4) to form a removable cape;

15. Fitting the cape 10 onto the user 12 by spreading the access opening at the slit 19 to place the cape 10 around the neck having the neck aligned in the neck hole 20;

16. Attaching the connector 57 on the first edge 23*a* to the sheet adjacent to the second edge 23*b* to retain the cape 10 in position on the user 12;

17. Placing the cape 10 over the utility aligning the drain 38, the faucet 32, the first handle 34 and the second handle 36 through the respective holes 33, 35, 37, 39; and 18. Securing the cape 10 to the utility by magnets, tape or the like to hold the cape 10 in position while in use.

In use, the sheet may comprise extruded or woven material. The sheet may be treated to resist reaction with biological or chemical or other waste products used during the personal care treatment. The sheet may be new material or a recycled material cut and configured to adapt to the user 12/sink 16 configuration needed.

Although the invention has been described above in connection with particular embodiments and examples, it will be appreciated by those skilled in the art that the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein.

We claim:

1. A cape for protecting a user having a neck and a sink having a drain and a faucet from damage by chemical or biological waste generated during a personal care procedure, the cape comprising:

a neck portion adapted to be secured to the neck of the user;

an outer edge spaced from the neck portion to cover the user and extend over the sink;

a plurality of holes formed in the cape to adapt to the sink;

a connector for holding the cape to the sink; and wherein the connector comprises a drain ring adapted to be inserted into the drain with the cape pinched between the drain ring and the drain to secure the cape at the drain.

2. The cape according to claim 1, wherein the drain ring comprises a helix shaped, non-continuous flexible device.

3. The cape according to claim 2, wherein the drain ring further comprises a first end, a second end and a flex portion, and the drain ring is compressible by flexing the flex portion to move the first end toward the second end and reduce a diameter of the drain ring so that the drain ring can be inserted into the drain with the cape pinched between the drain ring and the drain.

4. The cape according to claim 1, further comprising a user portion and a sink portion, wherein the user portion includes the neck portion and has a neck hole for removably attaching the cape to the user, wherein the plurality of holes formed in the cape to adapt to the sink includes a drain hole and a faucet hole, and wherein the sink portion has the drain hole and the faucet hole for covering the sink while extending the faucet of the sink through the faucet hole and allowing fluid communication through the cape at the drain hole to the drain of the sink.

5. The cape according to claim 4, wherein the drain ring comprises a helix shaped, non-continuous flexible device.

6. The cape according to claim 1, wherein the connector comprises a magnet.

7. The cape according to claim 1, wherein the cape comprises a water resistant material.

8. The cape according to claim 7, wherein the water resistant material resists at least one of biological, chemical, and waste products used during personal care treatments.

9. The cape according to claim 1, wherein the cape comprises a flexible material to drape over the user and the sink.

10. A protection system for use during a personal care procedure to protect a user having a neck, the system comprising:

a sink having a drain and a faucet;

a cape comprising:

a neck portion adapted to be secured to the neck of the user;

an outer edge spaced from the neck portion and covering the user and extending over the sink to cover the sink; and a drain hole formed in the cape and aligned with the drain and providing fluid communication through the cape at the drain hole to the drain.

11. The protection system according to claim 10, further comprising a connector for holding the cape to the sink.

12. The protection system according to claim 11, wherein the connector comprises a magnet.

13. The protection system according to claim 11, wherein the connector comprises a drain ring inserted into the drain with the cape pinched between the drain ring and the drain to secure the cape at the drain.

14. The protection system according to claim 13, wherein the drain ring comprises a helix shaped, non-continuous flexible device.

15. The protection system according to claim 14, wherein the drain ring further comprises a first end, a second end and a flex portion, and the drain ring is compressible by flexing the flex portion to move the first end toward the second end and reduce a diameter of the drain ring so that the drain ring can be inserted into the drain with the cape pinched between the drain ring and the drain.

16. The protection system according to claim 10, wherein the cape further comprises a user portion and a sink portion, wherein the user portion includes the neck portion and has a neck hole for removably attaching the cape to the user, and wherein the sink portion has a faucet hole covering the sink with the faucet of the sink extending through the faucet hole.

17. The protection system according to claim 10, wherein the cape comprises a water resistant material.

18. The protection system according to claim 17, wherein the water resistant material resists at least one of biological, chemical, and waste products used during personal care treatments.

19. The protection system according to claim 10, wherein the cape comprises a flexible material to drape over the user and the sink.

* * * * *